US006897810B2

(12) United States Patent
Dai et al.

(10) Patent No.: US 6,897,810 B2
(45) Date of Patent: May 24, 2005

(54) MULTI-BAND ANTENNA

(75) Inventors: Hsin Kuo Dai, Tu-Chen (TW); Lung Sheng Tai, Tu-chen (TW); Hsien-Chu Lin, Tu-chen (TW); Chia-Ming Kuo, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 11 days.

(21) Appl. No.: 10/315,687

(22) Filed: Dec. 9, 2002

(65) Prior Publication Data

US 2004/0090374 A1 May 13, 2004

(30) Foreign Application Priority Data

Nov. 13, 2002 (TW) ..... 91218157

(51) Int. Cl.[7] ..... H01Q 1/38
(52) U.S. Cl. ..... 343/700 MS; 343/702
(58) Field of Search ..... 343/702, 700 MS, 343/873, 846, 848, 725, 728; H01Q 1/38, 1/24

(56) References Cited

U.S. PATENT DOCUMENTS 6,002,367 A 12/1999 Engblom et al.
6,072,434 A 6/2000 Papatheodoron
6,204,819 B1 3/2001 Hayes et al.
6,346,914 B1 * 2/2002 Annamaa ..... 343/700 MS
2003/0107518 A1 * 6/2003 Li et al. ..... 343/702
2003/0201942 A1 * 10/2003 Poilasne et al. ..... 343/702
2004/0017319 A1 * 1/2004 Wang et al. ..... 343/702

OTHER PUBLICATIONS

Fang–I Hsu, "Planar Near–Field to Far–Field Transformation and PIFA Antenna Suitable for Wireless LAN", Paper of Institute of Communication Engineering National Chiao Tung University of Taiwan, 2001, http//datas.ncl.edu.tw/.

* cited by examiner

*Primary Examiner*—Hoanganh Le
(74) *Attorney, Agent, or Firm*—Wei Te Chung

(57) ABSTRACT

A multi-band antenna (1) includes a ground patch (10), a first radiating patch (21), a second radiating patch (22), a connecting patch (23) connecting the first and second radiating patches with the ground patch, and a feeder cable (40). The ground patch, the connecting patch, the second radiating patch and the feeder cable form a planar inverted-F antenna (PIFA), and the first radiating patch, the connecting patch, the ground patch and the feeder cable form a loop antenna.

13 Claims, 9 Drawing Sheets

Scale: 5 dBi/div
Operating Frequency: 2.484 GHz
Horizontally Polarized

Scale: 5 dBi/div
Operating Frequency: 2.484 GHz
Vertically Polarized

Scale: 5 dBi/div
Operating Frequency: 5.35 GHz
Horizontally Polarized

Scale: 5 dBi/div
Operating Frequency: 5.35 GHz
Vertically Polarized

Scale: 5 dBi/div
Operating Frequency: 5.725 GHz
Horizontally Polarized

Scale: 5 dBi/div
Operating Frequency: 5.725 GHz
Vertically Polarized

MULTI-BAND ANTENNA

CROSS-REFERENCE TO RELATED APPLICATIONS

This present application is related to a other two patent applications commonly entitled "MULTI-BAND ANTENNA", invented by the same inventors, and assigned to a common assignee.

BACKGROUND OF THE INVENTION

1. Field of the Invention

The present invention relates to an antenna, and in particular to a multi-band antenna employed in a mobile electronic device.

2. Description of the Prior Art

In 1999, the wireless local area network (WLAN) market saw the introduction of the 2.4 GHz IEEE 802.11b standard. Today 802.11b and IEEE 802.11a are among several technologies competing for market leadership and dominance.

The wireless 802.11a standard for WLAN runs in the 5 GHz spectrum, from 5.15–5.825 GHz. 802.11a utilizes the 300 MHz of bandwidth in the 5 GHz Unlicensed National Information Infrastructure (U-NII) band. Although the lower 200 MHz is physically contiguous, the Federal Communications Commission (FCC) has divided the total 300 MHz into three distinct 100 MHz realms; low (5.15–5.25 GHz), middle (5.25–5.35 GHz) and high (5.725–5.825 GHz), each with a different legal maximum power output in the U.S.

802.11a/b dual-mode WLAN products are becoming more prevalent up in the market, so there is a growing need for dual-band antennas for use in such products to adapt them for dual-mode operation. A dual-band planar inverted-F antenna (PIFA) is a good miniaturized built-in antenna for mobile electronic products. However, the bandwidth of the conventional dual-band PIFA antenna is not wide enough to cover the total bandwidth of 802.11a and 802.11b. Generally, because of this narrowband characteristic, the bandwidth of the dual-band PIFA can only cover the bandwidth of 802.11b and one or two bands of 802.11a.

One solution to the above problem is to combine two, or more than two, types of antennas. For example, U.S. Pat. No. 6,204,819 B1 discloses an antenna combining a PIFA and a loop antenna, which are selected by a plurality of switches. Though this antenna can achieve wider bandwidth by adjusting the parameters of the loop antenna, the tridimensional structure of this antenna occupies more space in an electronic device, and the employment of those switches increases the complexity and the cost of this antenna.

Hence, an improved antenna is desired to overcome the above-mentioned shortcomings of existing antennas.

BRIEF SUMMARY OF THE INVENTION

A primary object, therefore, of the present invention is to provide a multi-band antenna combining two different types of antennas for operating in different frequency bands.

A multi-band antenna in accordance with the present invention for an electronic device includes a ground patch, a first radiating patch, a second radiating patch, a connecting patch connecting the first and second radiating patches with the ground patch, and a feeder cable. The multi-band antenna further comprises an insulative planar base, and the ground patch, the first radiating patch, the second radiating patch and the connecting patch are made of thin sheet metal and are arranged on a same surface of the insulative planar base. The ground patch, the connecting patch, the second radiating patch and the feeder cable form a planar inverted-F antenna (PIFA) for receiving or transmitting lower frequency signals, while the first radiating patch, the connecting patch, the ground patch and the feeder cable form a loop antenna for receiving or transmitting higher frequency signals.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
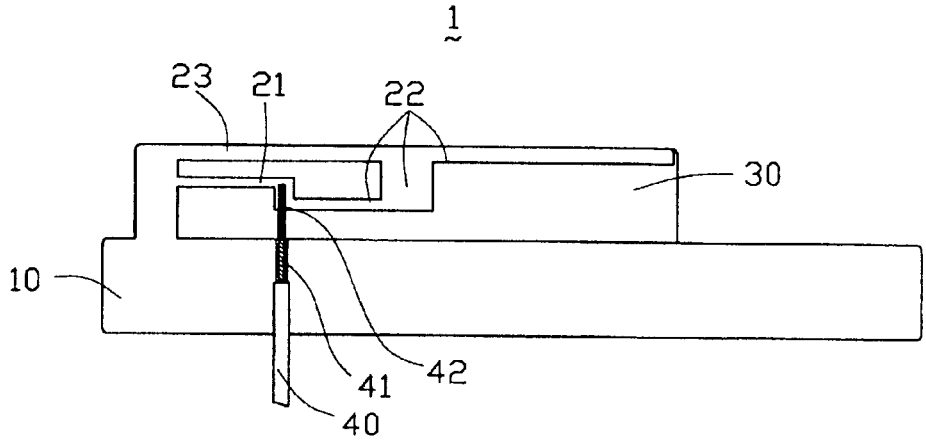
FIG. 1 is a plan view of a preferred embodiment of a multi-band antenna in accordance with the present invention, with a coaxial cable electrically connected thereto.

Referring to FIG. 1, a multi-band antenna 1 in accordance with a preferred embodiment of the present invention comprises an insulative planar base 30, a ground patch 10, a first radiating patch 21, a second radiating patch 22, a connecting patch 23 and a signal feeder cable 40.

The ground patch 10, the first radiating patch 21, the second radiating patch 22 and the connecting patch 23 are made from conductive sheet metal, are arranged on a same surface of the insulative planar base 30, and electrically connect with one another. The connecting patch 23 connects at a first end to the ground patch 10, at a medial portion to a first end of the first radiating patch 21, and at a second end to a medial portion of the second radiating patch 22. A second end of the first radiating patch 21 connects with a first end of the second radiating patch 22, and a second end of the second radiating patch 22 is a free end and extends parallel to the ground patch 10.

The signal feeder cable 40 is a coaxial cable and comprises a conductive inner core 42, a dielectric layer (not labeled), a conductive outer shield 41 over the dielectric layer, and an outer jacket (not labeled). The inner core 42 is soldered onto a top surface of a connecting point of the first radiating patch 21 and the second radiating patch 22, and the outer shield 41 is soldered onto a top surface of the ground patch 10.

The inner core 42, the first radiating patch 21, the connecting patch 23, the ground patch 10 and the outer shield 41 connect in turn to form a loop antenna for receiving or transmitting higher frequency signals. The second radiating patch 22, the connecting patch 23, the ground patch 10 and the feeder cable 40 connect to form a planar inverted-F antenna (PIFA) for receiving or transmitting lower frequency signals.

Figure 2:
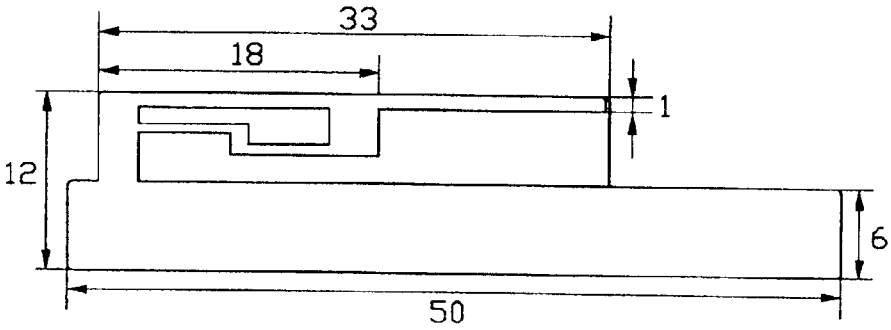
FIG. 2 is a plan view of the multi-band antenna of FIG. 1, illustrating some dimensions of the multi-band antenna.

Referring to FIG. 2, major dimensions of the multi-band antenna 1 are labeled thereon, wherein all dimensions are in millimeters (mm).

In assembly, the multi-band antenna 1 is assembled in an electronic device (e.g. a laptop computer, not shown) by the insulative planar base 30. The ground patch 10 is grounded. RF signals are fed to the multi-band antenna 1 by the conductive inner core 42 of the feeder cable 40 and the conductive outer shield 41.

Figure 3:
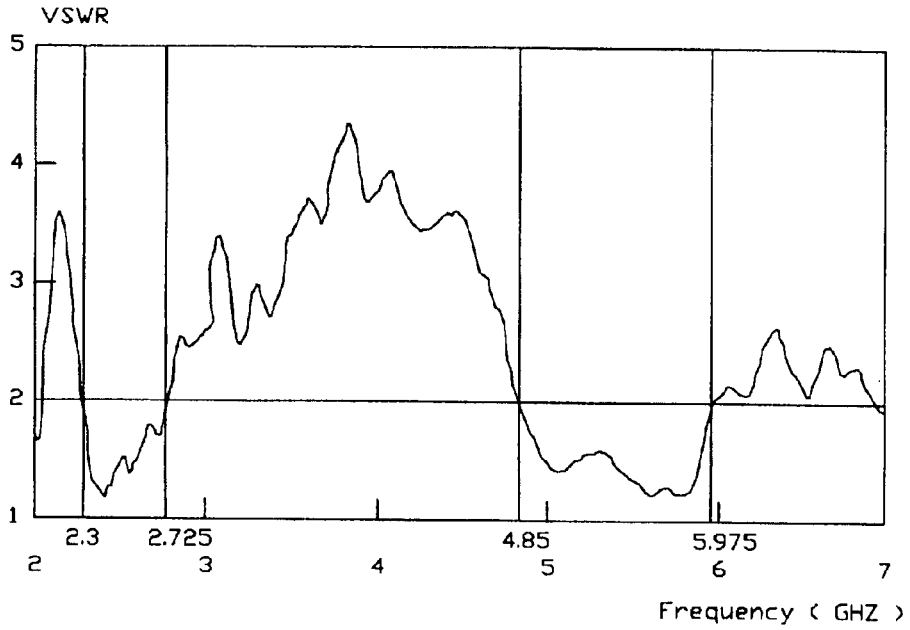
FIG. 3 is a test chart recording for the multi-band antenna of FIG. 1, showing Voltage Standing Wave Ratio (VSWR) as a function of frequency.
Figure 4:
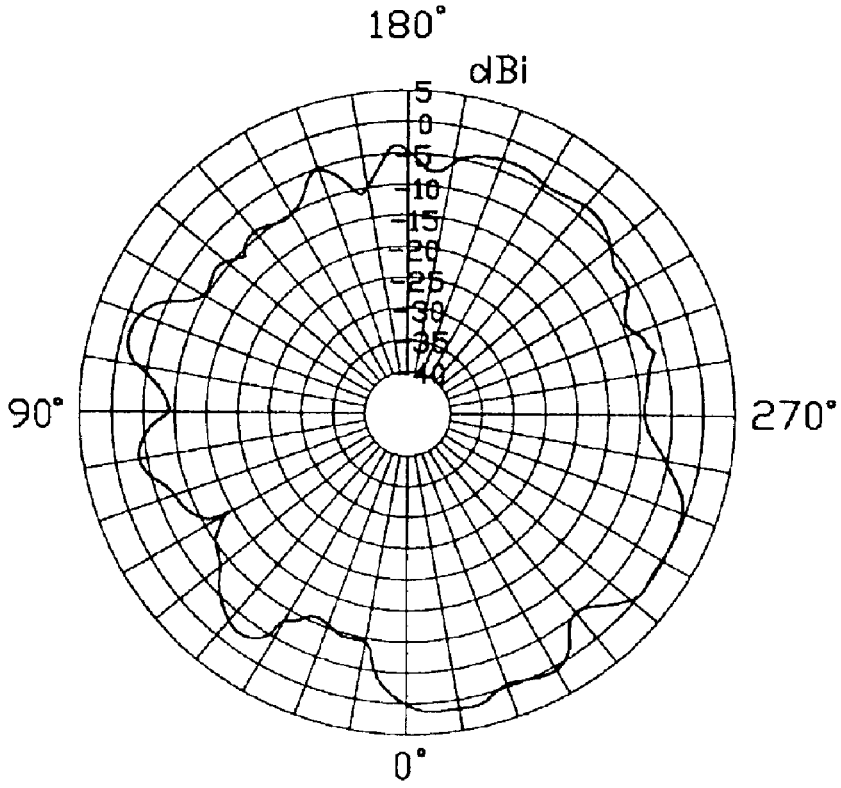
FIG. 4 is a recording of a horizontally polarized principle plane radiation pattern of the multi-band antenna of FIG. 1 operating at a frequency of 2.484 GHz.
Figure 5:
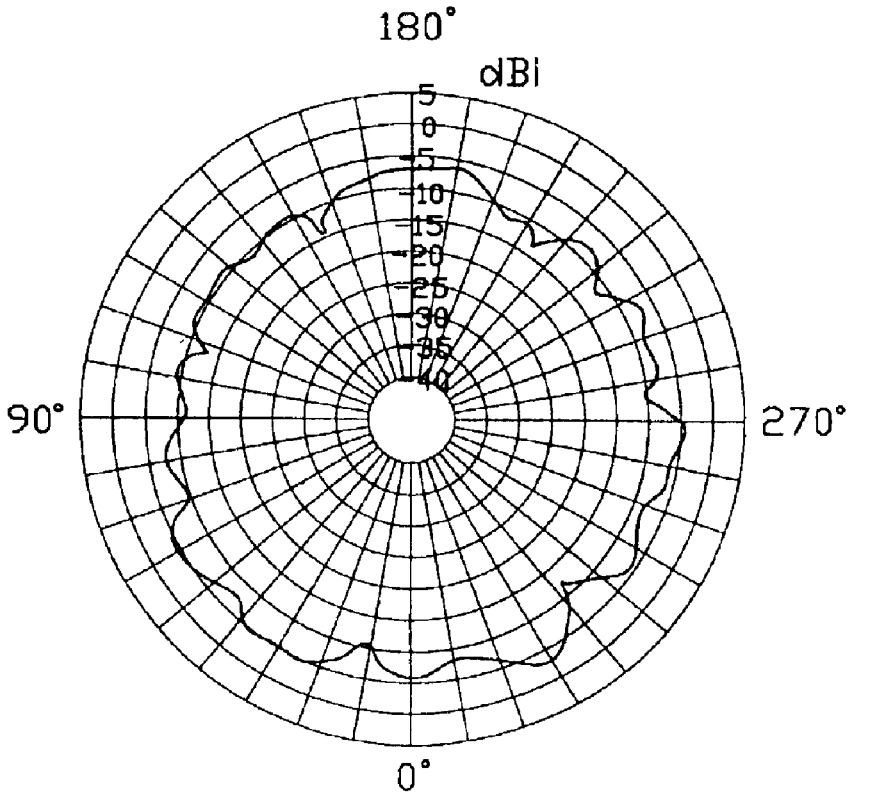
FIG. 5 is a recording of a vertically polarized principle plane radiation pattern of the multi-band antenna of FIG. 1 operating at a frequency of 2.484 GHz.
Figure 6:
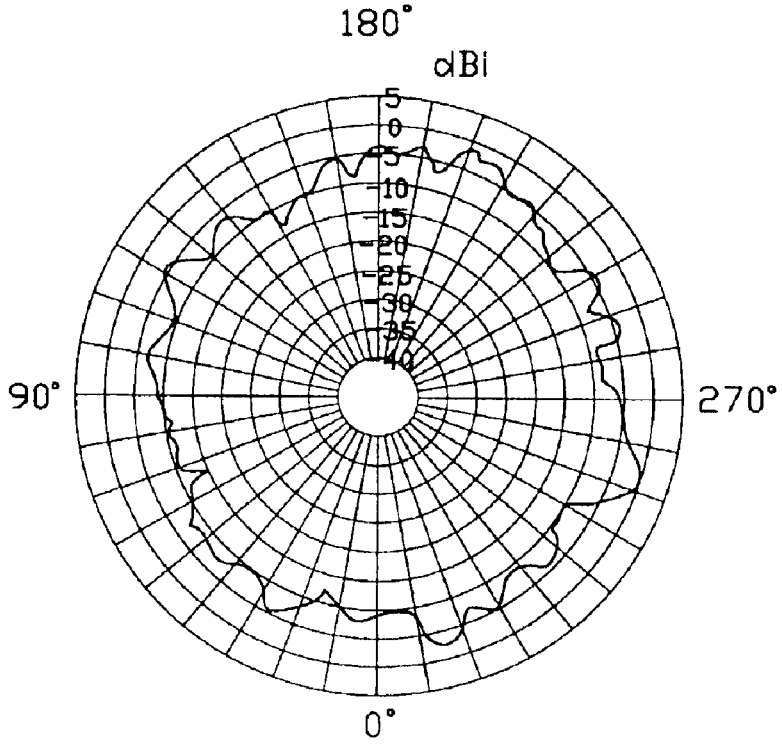
FIG. 6 is a recording of a horizontally polarized principle plane radiation pattern of the multi-band antenna of FIG. 1 operating at a frequency of 5.35 GHz.
Figure 7:
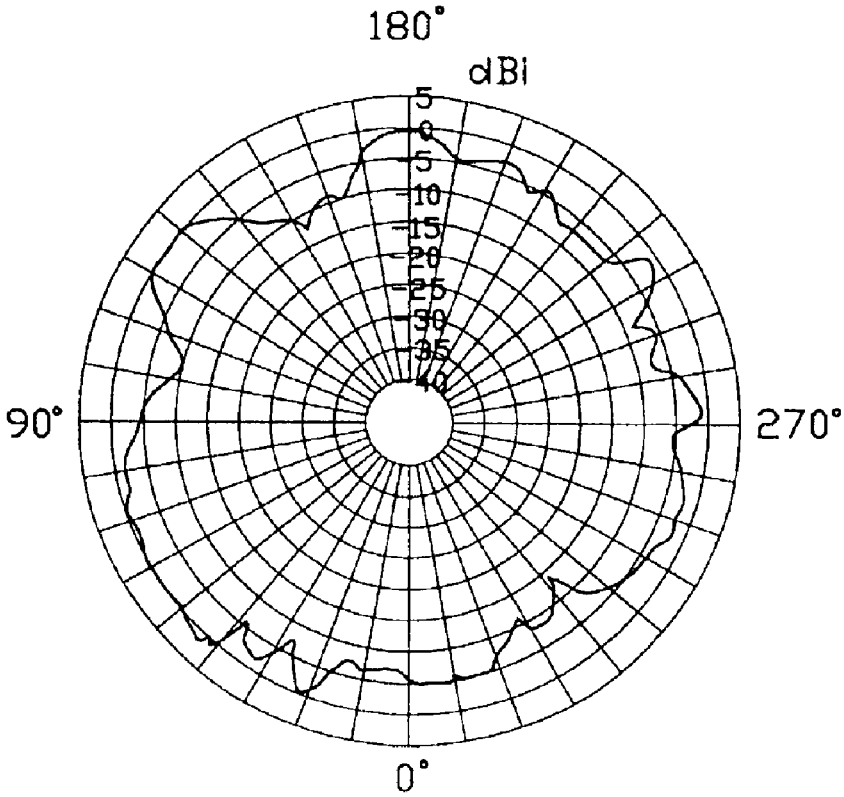
FIG. 7 is a recording of a vertically polarized principle plane radiation pattern of the multi-band antenna of FIG. 1 operating at a frequency of 5.35 GHz.
Figure 8:
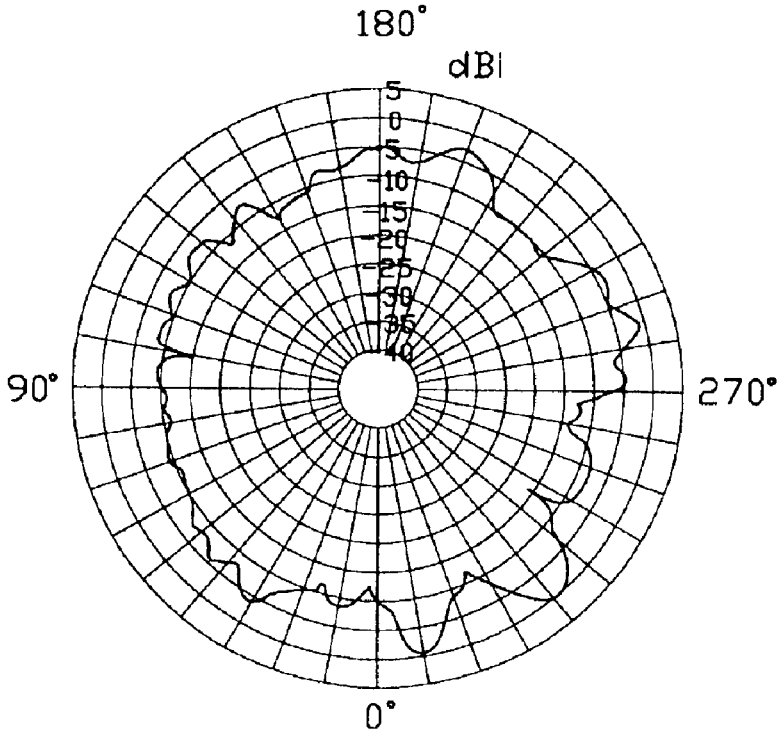
FIG. 8 is a recording of a horizontally polarized principle plane radiation pattern of the multi-band antenna of FIG. 1 operating at a frequency of 5.725 GHz.
Figure 9:
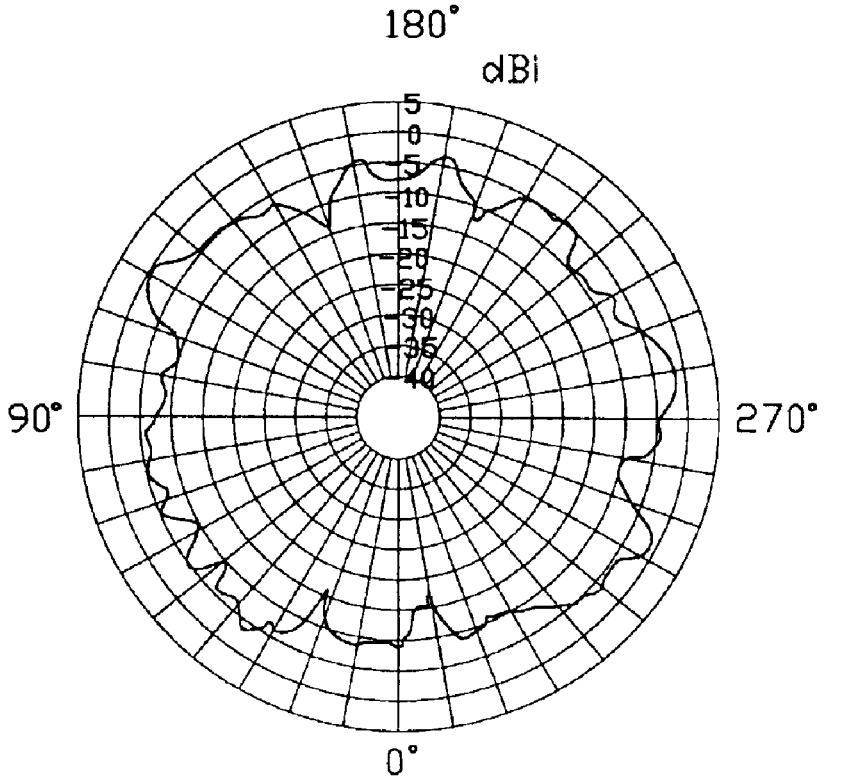
FIG. 9 is a recording of a vertically polarized principle plane radiation pattern of the multi-band antenna of FIG. 1 operating at a frequency of 5.725 GHz.

FIG. 3 shows a test chart recording of Voltage Standing Wave Ratio (VSWR) of the multi-band antenna 1 as a function of frequency. Note that VSWR drops below the desirable maximum value "2" in the 2.3–2.725 GHz frequency band and in the 4.85–5.975 GHz frequency band, indicating acceptably efficient operation in these two wide frequency bands, which cover more than the total bandwidth of the 802.11a and 802.11b standards.

FIGS. 4-9 respectively show horizontally and vertically polarized principle plane radiation patterns of the multi-band antenna 1 operating at frequencies of 2.484 GHz, 5.35 GHz, and 5.725 GHz. Note that each radiation pattern is close to a corresponding optimal radiation pattern and there is no obvious radiating blind area.

The location of the solder point of the inner core 42 on the first radiating patch 21 and the second radiating patch 22 is predetermined to achieve a desired matching impedance and an optimal VSWR for both bands. Additionally, the resonance point of the multi-band antenna 1 can be adjusted by changing the dimensions of the first radiating patch 21 or the second radiating patch 2, or changing the location of the solder point of the inner core 42. For example, when the location of the solder point of the inner core 42 moves to the first radiating patch 21, the high frequency resonance point of the multi-band antenna 1 will move to higher frequency and the low frequency resonance point will move to lower frequency; when the location of the solder point of the inner core 42 moves to the second radiating patch 22, the high frequency resonance point of the multi-band antenna 1 will move to lower frequency and the low frequency resonance point will move to higher frequency It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna for an electronic device, comprising:

a ground patch;

a first radiating patch;

a second radiating patch;

a connecting patch connecting the first and second radiating patches with the ground patch; and a feeder cable;

wherein the first radiating patch comprises a first end connected to the connecting patch and a second end connected to a first end of the second radiating patch.

2. The multi-band antenna as claimed in claim 1, wherein the connecting patch connects at a first end to the ground patch, at a medial portion to the first end of the first radiating patch, and at a second end to a medial portion of the second radiating patch.

3. The multi-band antenna as claimed in claim 1, wherein a second end of the second radiating patch is a free end and extends parallel to the grounding patch.

4. The multi-band antenna as claimed in claim 1, wherein the feeder cable is a coaxial cable feeder and comprises a conductive inner core wire and a conductive outer shield.

5. The multi-band antenna as claimed in claim 4, wherein the inner core wire is electrically connected to the connecting portion of the first radiating patch and the second radiating patch, and the outer shield is electrically connected to the ground patch.

6. The multi-band antenna as claimed in claim 1, further comprising an insulative planar base, wherein the ground patch, the first radiating patch, the second radiating patch and the connecting patch are arranged on a same surface of the insulative planer base.

7. The multi-band antenna as claimed in claim 1, wherein the ground patch, the connecting patch, the second radiating patch and the feeder cable form a planar inverted-F antenna (PIFA), and the first radiating patch, the connecting patch, the ground patch and the feeder cable form a loop antenna.

8. A multi-band antenna for an electronic device, comprising:

a generally planar inverted-F antenna (PIFA) comprising a radiating patch and a ground patch which are substantially arranged in a plane;

a loop antenna, arranged in the same plane with the inverted-F antenna (PIFA); and a feeder cable to feed both the PIFA and the loop antenna.

9. The multi-band antenna as claimed in claim 8, wherein the PIFA operates in a lower frequency band, and the loop antenna operates in a higher frequency band.

10. A substrate multi-band antenna for an electronic device, comprising:

a cable including an inner core and a grounding braiding surrounding said inner core;

first and second radiating patches extending oppositely by two sides of said cable;

a ground patch spaced from both said first and second radiating patches; and a connecting patch respectively connecting said first radiating patch and said second radiating patch to the ground patch; wherein the inner core is connected to an junction of said first radiating patch and said second radiating patch, and the grounding braiding is connected to the ground patch.

11. The antenna as claimed in claim 10, wherein a portion of a connection path provided by the connecting patch from the second radiating patch to the ground patch, is same as that provided by the connecting patch from the first radiating patch to the ground patch.

12. The antenna as claimed in claim 10, wherein a distance between the first radiating patch and the ground patch, is different from that between the second radiating patch and the ground patch.

13. The antenna as claimed in claim 10, wherein said first radiating patch is of straight line while the second radiating patch includes two turns.

* * * * *